US006553901B2

(12) United States Patent
Reddoch

(10) Patent No.: US 6,553,901 B2
(45) Date of Patent: Apr. 29, 2003

(54) DRILLING FLUID RECOVERY AND CUTTINGS PROCESSING SYSTEM

(76) Inventor: Jeffrey Reddoch, P.O. Box 82098, Lafayette, LA (US) 70598-2098

( * ) Notice: Subject to any disclaimer, the term of this patent is extended or adjusted under 35 U.S.C. 154(b) by 0 days.

(21) Appl. No.: 09/906,944

(22) Filed: Jul. 16, 2001

(65) Prior Publication Data

US 2001/0039887 A1 Nov. 15, 2001

Related U.S. Application Data

(63) Continuation-in-part of application No. 09/454,081, filed on Dec. 3, 1999, now Pat. No. 6,279,471, which is a continuation-in-part of application No. 08/713,604, filed on Sep. 13, 1966, now Pat. No. 5,996,484.

(51) Int. Cl.[7] ..... B30B 15/30

(52) U.S. Cl. ..... 100/45; 100/374; 100/106; 175/66

(58) Field of Search ..... 175/66, 206, 207; 100/37, 45, 71–75, 90, 91, 106, 112, 117, 126–129, 131, 147, 148; 208/13, 277, 323

(56) References Cited

U.S. PATENT DOCUMENTS

| | | | | |
|---|---|---|---|---|
| 4,546,783 A | | 10/1985 | Lott | |
| 4,709,628 A | | 12/1987 | Glowacki | |
| 5,009,795 A | | 4/1991 | Eichler | |
| 5,129,468 A | | 7/1992 | Parmenter | |
| 5,303,786 A | | 4/1994 | Prestridge et al. | |
| 5,330,017 A | | 7/1994 | Hart et al. | |
| 5,361,998 A | | 11/1994 | Sirevag et al. | |
| 6,170,580 B1 | * | 1/2001 | Reddoch | 175/66 |

* cited by examiner

*Primary Examiner*—W. Donald Bray
(74) *Attorney, Agent, or Firm*—Robert N. Montgomery

(57) ABSTRACT

A drill cuttings slurry process system is disclosed for defluidizing earth drill cuttings, thereby extracting valuable drilling additives and returning them to the drilling system while producing a dense, drier material which may be discharged directly in the environment at or near the well being drilled or chemically treated for distillation and/or better dissolution into the environment, thereby reducing, cost in transportation and environmental treatment chemicals thus reducing environmental contamination. The system comprising a cuttings press having solids/fluids separation a dryer and/or a retort for flashing off any residual petroleum residue and moisture, a fines grinder and a chemical injection system. The retort including an analyzer system for weighing and determining rate of throughput and analyzing the cuttings for residual petroleum residue content prior to discharge to environment or further refinement prior to reinjection into the well or transport to environmental depository sites.

13 Claims, 14 Drawing Sheets

DRILLING FLUID RECOVERY AND CUTTINGS PROCESSING SYSTEM

This is a continuation-in-part of previous application Ser. No. 09/454,081 filed Dec. 3, 1999 now U.S. Pat. No. 6,279,471 which is a continuation-in-part of application Ser. No. 08/713,604, filed Sep. 13, 1966, now U.S. Pat. No. 5,996,484.

SPECIFICATION

BACKGROUND OF THE INVENTION

1. Field of the Invention

The field of the present invention relates generally to the recovery of drilling fluids from oil and gas drilling/production operations, more particularly, a method and system utilizing various types of presses for the recovery of such drilling fluids through compaction and defluidization of entrained solids in a cuttings slurry prior to such cuttings being injected into a well casing or in conjunction with other environmental distribution and/or disposal operations. The system further entails an extensive drying and particle sizing process and the treatment of such cuttings prior to reinjection or distribution into the environment. The system further includes a computerized weighing and analyization system to determine the volume of cuttings being removed at any given time from the well being drilled and the percentage of residual petroleum residue present at point of discharge. The system may also be automated to allow discharge and routing of cuttings depending on their environmental quality.

2. General Background

In oil well drilling operations, drilling fluid containing additives is circulated downwardly through the drill string to lubricate and remove cuttings from the bit. A mixture containing drilling fluid and cuttings is then returned to the surface through and annulus around the drill pipe "Adherent drilling fluid" is defined as drilling fluid adhering to the drill cuttings, and, if the drilling fluid is oil-based, the adherent drilling fluid also includes oil.

It is well known that the drill cuttings must be separated from the drilling fluid so that the drilling fluid can be recirculated. Additionally, solid cuttings generated in a drilling process, such as during exploration for oil or gas, which have been contaminated with adherent drilling fluid must be cleansed to remove surface contaminates prior to discharge of the cuttings to the environment.

Several such methods and apparatus are disclosed by U.S. Pat. Nos. 5,361,998, 5,303786, 5,129,468, and 4,546,783. Such apparatus are particularly beneficial in laundering or cleansing of drill cuttings on offshore drill platforms so that the drill cuttings are environmentally safe for discharge into the sea. However, the loss of a portion of the adherent fluids is inevitable and is becoming more of a concern.

Hart in U.S. Pat. No. 5,330,017 expresses many of the problems associated with drilling fluid recovery for onshore operations. Hart suggests that, due to environmental concerns, much of the slurry is transported in a fluid or semi-fluid state to approved disposal sites. Such sites utilize deep wells whereby hazardous waste can be injected back into the earth or mixed with chemicals such as lye and fly ash , which render the materials acceptable for land reclamation. Disposal sites may also provide centrifuges as a means of defluidizing the slurry and rely heavily on polymers added to the effluent to render the discharge liquids safe for reintroduction into the environment.

Many recovery and treatment apparatus utilize separate cells having low speed agitators to stir a mixture of cutting and cleansing solution called surfactants. The cuttings are transferred from one cell to the next where additional agitation and cleansing take place. Thereafter, a slurry of cleansed drill cuttings and surfactant is pumped from the cells to a vibrating screen operation whereby most of the surfactant is removed and sent back to the system. In some cases a portion of the surfactant solution, which is rich in fine drill cuttings and adherent drilling fluids, is run through one or more hydrocyclone separators which discharge the fine drill cuttings in solution separated from the larger, cleansed drill cuttings. However, it has been the practice in the past to simply pass the cuttings over one or more vibrating screens to recover the majority of the drilling additives and discharge the remainder as waste material. In any case, it is the overflow and underflow of such discharge slurries comprising surfactant solution, drilling fluid, and entrained fine drill cuttings, which is the focus element of the present invention. As discussed by Lott in U.S. Pat. No. 4,546,783, hydrocyclones used in the recovery system tend to lose 4% of the surfactant solution alone in the process, which is environmentally and economically undesirable. An even greater percentage of drilling fluids are also lost in the process. Lott further suggested a process and apparatus for recovering more of the surfactant. However, Lott's use of a vacuum chamber and a drag link conveyer to clear additional shaker screens, the use of a second hydrocyclone, gas spargers and liquid spray nozzles to induce the entrained solids to rise to the surface in yet another decanter so that they can be drained off into a second decanter prior to disposal, seems to be an over-complication of the process. However, such drastic measures to recover only 4% of the surfactant, along with the drilling fluids, is indicative of the need for a more efficient method of recovery.

Although screw presses have been widely used in the agricultural industry to dewater fibrous slurries, such presses have not gained acceptance in the earth drilling industry for a number of reasons. Compressing earth cuttings developed from drilling operations would be difficult under most conditions, due to the volume, the abrasiveness, and non-uniformity of such materials. Dewatering screw conveyors and screen conveyor systems have been used with some success in mining operations to remove a large portion of the residual water. However, the drilling additives associated with petroleum drilling operations make defluidizing more complicated. It has been found that screw presses, such as disclosed by Eichler in U.S. Pat. No. 5,009,795, could serve as the basis for a defluidizing press in the present invention concept. However, due to the nature of the materials handled, abrasiveness, and the material's lack of compressibility, a more robust screw flighting and a much finer screen are required. A means of controlling the flow of material to form compaction is also required which will not restrict the material discharge. It is also known, according to Gloacki's U.S. Pat. No. 4,709,628, that a variable damper having a conical shape can be used to control the material discharge of such screw presses. However, Glowacki uses a plurality of flaps, which would become compacted or misshaped and impair the flow of heavy non-compressible materials such as earth cuttings. Therefore, a more rigid conical or elliptical shape would be more practical. It has therefore been found that a defluidizing type press designed specifically to handle a slurry of drill cuttings may be utilized to recover drilling fluids while defluidizing the discharge cuttings, thereby resulting in a savings of costly drilling additives and reducing the volume of discharge into the environment. Such savings are further enhanced as a result of a reduction in environmental additives, such as lime and fly ash, and other such chemicals used to neutralize the discharge waste material when being reintroduced into the environment. By defluidizing the discharge slurry, the volume of disposable material is reduced. Therefore, fewer chemicals are required to treat the material before introduction into the environment.

When the cuttings are rendered essentially free of contaminates it may be possible to discharging them directly back into the environment on site . Therefore, there is a need to reduce the cuttings to their lowest volume and in doing so improve their environmental quality by removing as many contaminants as possible thereby eliminating the need for expensive transport to environmental depository sites. A by product of the drying process is that a direct relationship between the throughput of the volume of cuttings being removed from the well and the volume of cuttings being discharged can be achieved. This provides the driller with valuable data. Reduction in volume further allows automation of the entire cuttings process heretofore unachievable.

SUMMARY OF THE PRESENT INVENTION

The present invention provides a means of recovery of drilling fluids from drilling fluid slurries containing entrained solids. Such slurries are derived directly from the cascading, vibrating screens in various drill cutting-processing systems. It has been found that any discharge from such systems which is considered suitable for disposal into the environment can now be cycled through a defluidizing press whereby up to 40% by volume of the remaining drilling fluids can be recovered in the defluidization process. A second defluidizing press may be used to further reduce the fluid content, thereby reducing the discharge volume. Several embodiments are disclosed which further define the process under various conditions. In addition, several types of defluidizing presses are disclosed which may prove applicable under various circumstances. It is anticipated that such defluidizing presses may be capable of replacing all or a significant part of the current processes, thus eliminating the cascading screens, hydrocyclones, and centrifuges. It should be understood that although the majority of the fluids from the cuttings are being recovered by utilizing the screw press and liquid screen as taught herein, the solids still retain a relatively high moisture content and still retain some petrochemicals. It is also desirable, in some cases, to reduce the solids to their lowest possible mass for transport and disposal into the environment. Therefore, systems are provided that utilize the defluidizing technology to allow the defluidized cuttings to be further processed by drying and flashing off any contaminates along with any remaining moisture, weighed and automatically discharged to the environment at the well site when a computerized analyzing system determines the contaminates to be within acceptable levels. The system may also be automated to further process the cuttings by fine grinding and otherwise conditioning the cutting for reinjection in the well being drilled or for transport and disposal a environmental depository sites. Such systems may simply include further treatment of the defluidized cuttings with chemicals to disperse the petrochemicals and assist in the biodegradation of the solids prior to reintroduction into the environment. Other more elaborate systems as taught herein also utilize the combustible petrochemical in the cuttings to assist in drying the solids prior to mixing environmentally enhancing chemicals.

Defluidized cuttings may be disposed of in any number of ways as disclosed herein, such as reinduction into well casing, transported, at a reduced volume cost, for injection at processing and disposal sites, or to distillation and land reclamation farms where fewer chemicals will be required to treat the materials prior to introduction into the environment.

It is, therefore, an object of the present invention to provide a means of recovery of a greater percentage of drilling fluids currently being lost in the disposition process.

Another object is to make the use of synthetic drilling additives more economical to use due to the recovery process.

Still another object of the invention is to reduce the quantity of fluids being transported for disposition, thereby making transport of disposable drill cuttings more economical.

Yet another object of the present invention is to reduce the drilling additives in the disposable cuttings, thereby reducing the quantity of biodegradation additives generally required by land farms.

This summary is a concise description of the use of a press system to recover expensive drilling fluid additives and a method for achieving the objectives stated and is not intended to limit or modify the scope of the invention as stated in the claims as follows.

BRIEF DESCRIPTION OF THE DRAWINGS

For a further understanding of the nature and objects of the present invention, reference should be made to following detailed description taken in conjunction with the accompanying drawings, in which like parts are given like reference numerals, and wherein.

DETAILED DESCRIPTION OF THE PREFERRED EMBODIMENT

Figure 1:
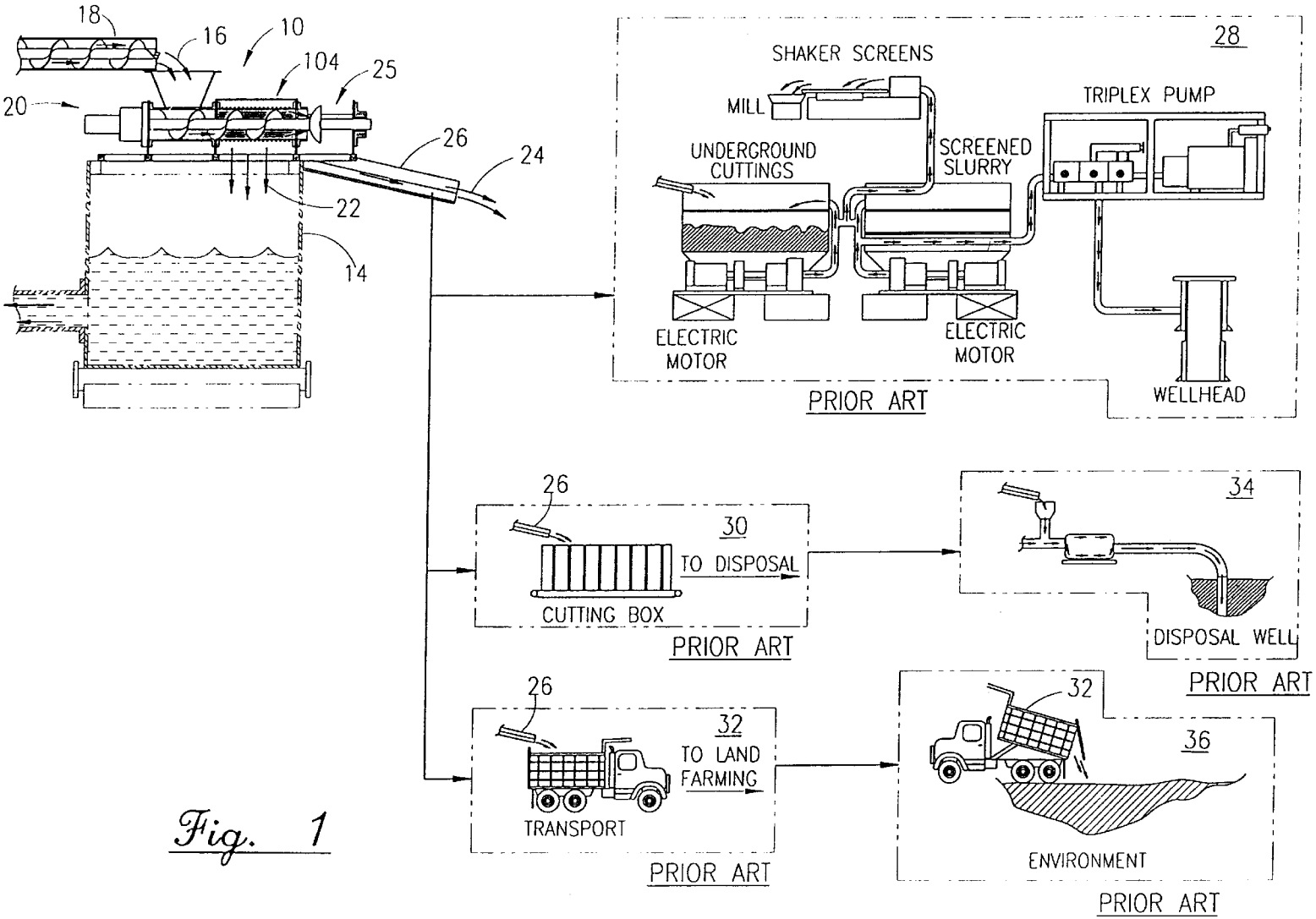
FIG. 1 is a diagram of the present invention in section view shown receiving slurry from a shaker screen system and discharging defluidized material to a well injection system, to cutting box for disposal at a hazardous waste site, or to a truck for disposition into a distillation process or the environment.
Figure 2:
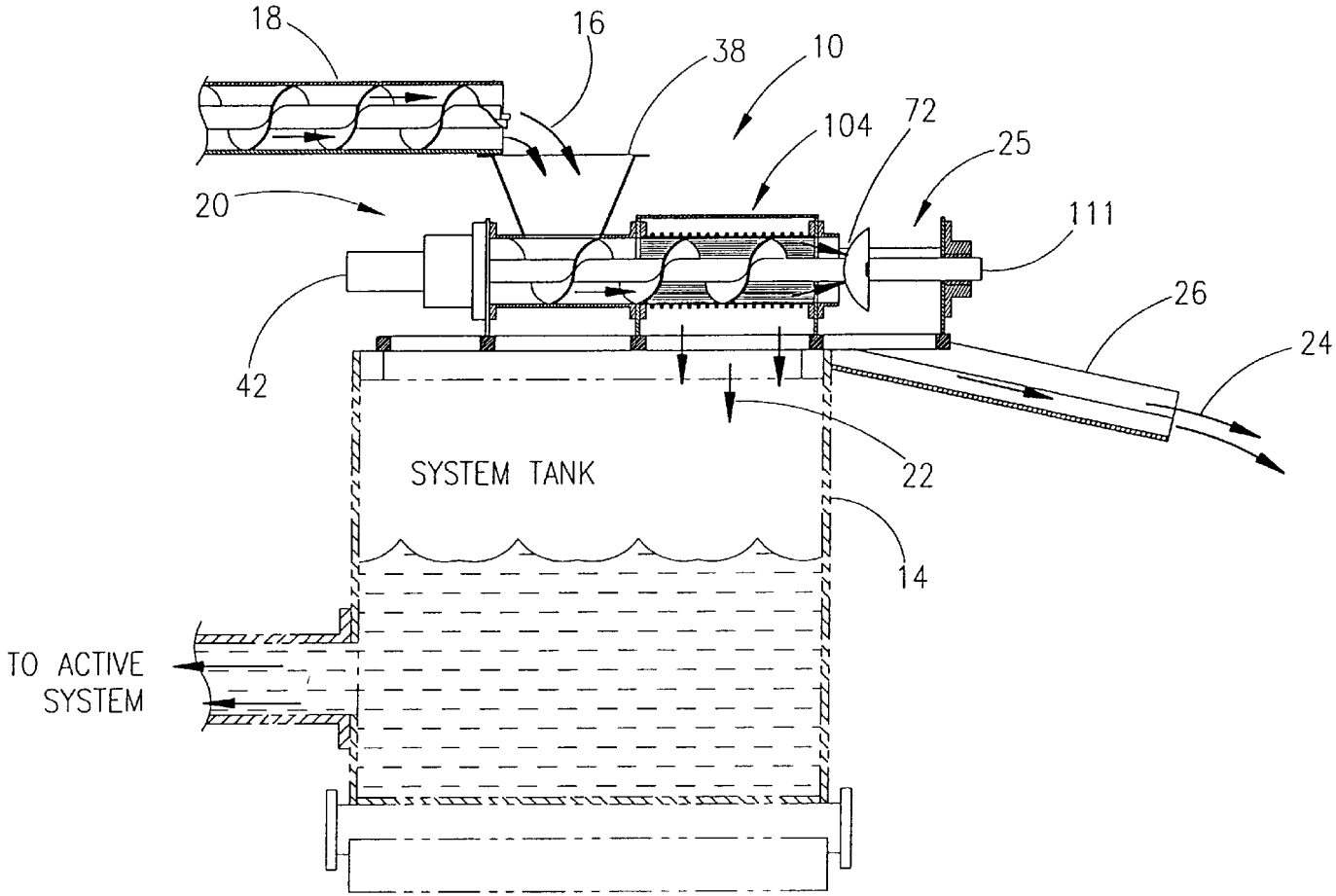
FIG. 2 is a partial cross section view of a system tank and the present invention mounted thereto, showing slurry material being discharged into a hopper.
Figure 3:
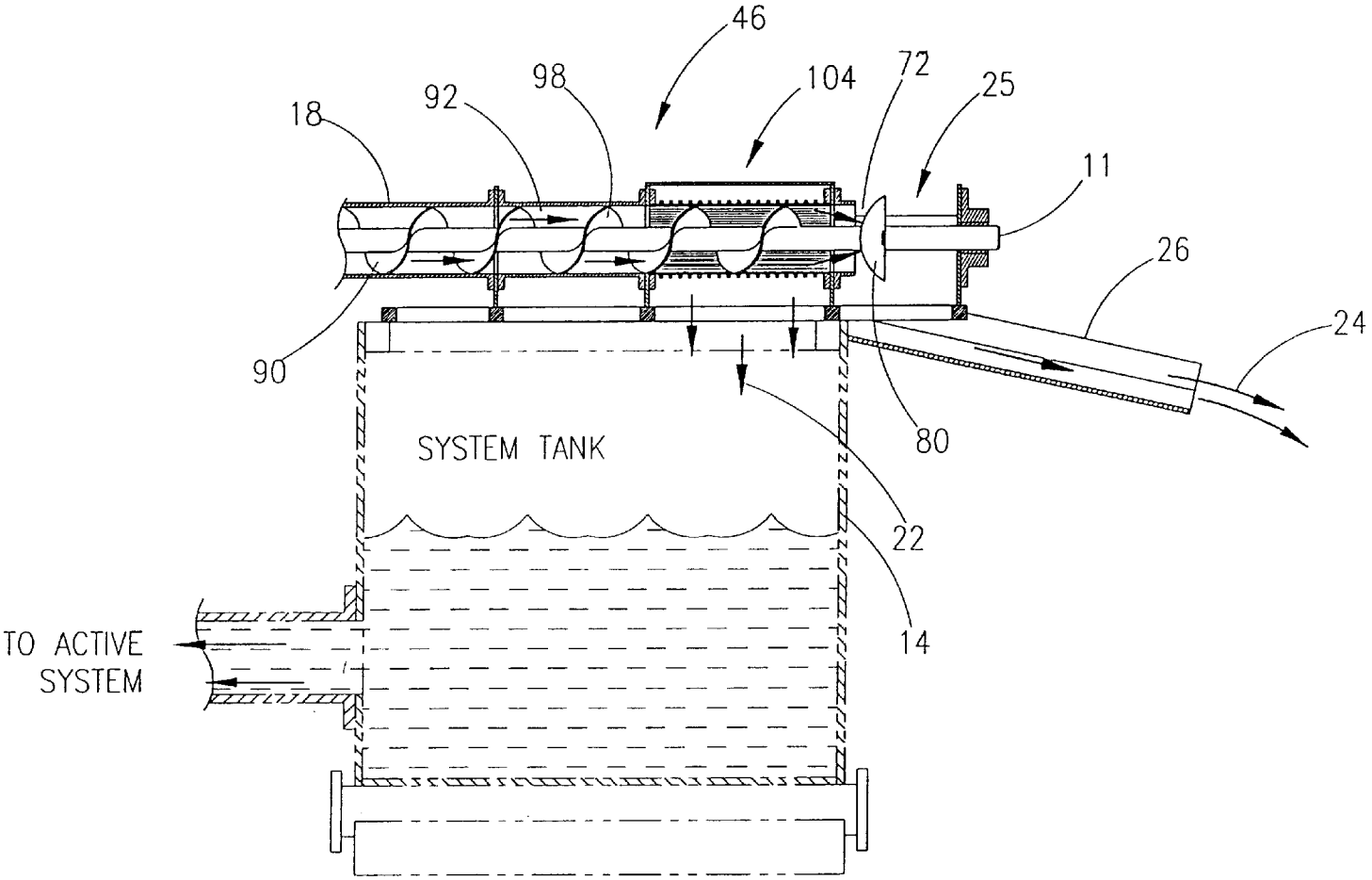
FIG. 3 is a partial cross section view of a system tank and the present invention mounted thereto, showing an infeed screw conveyor coupled directly to the feed screw of the present invention.

Referring first to FIG. 1 where the major components of the defluidization recovery system 10 starts with drill cuttings and drilling fluids in a slurry 16 collected from any source as overflow or underflow, usually from the rig's shaker screens (not shown). The slurry 16 is transported via a conveyor 18 to the screw press 20, shown here in cross section and better seen in FIG. 2, mounted on top of a fluid recovery tank 14, illustrating the flow path of the slurry 16 being defluidized. It is conceived that a screw press 20 or other compaction type presses depicted herein, having particular characteristics, could be mounted on or near a drilling fluids system tank 14 in which case drilling fluids contained in the overflow and underflow slurry 16 could be separated from the drill cuttings processing system prior to discharge into the environment. The slurry 16, in most cases, contains valuable drilling additives including synthetics and/or surfactants that after having passed through a wash system (not shown), could be fed via a screw conveyor 18 to the press 20 where the slurry 16 is defluidized. The cuttings, contained in the slurry 16, when compacted in the press 20, as a result of being forced through a compaction zone 25, forces the drilling fluids 22, which containing valuable drilling additives, to be discharged into the system tank 14 for recirculation in the drilling process. The separated defluidized cuttings residue 24 is then discharged via a discharge chute 26 to a drill cuttings injection system 28, to a cutting storage box 30, or to a transporting vehicle 32 for transport to a hazardous waste site for injection in a deep well 34, or treated for environmental disposal at a land reclamation farm 36. The slurry 16 may be conveyed to the press 20 in any accepted manner, such as screw conveyor 18, gravity feed, or by pump. However, in most cases this is done by gravity feed or screw conveyers 18, in which case the slurry 16 is discharged into a hopper 38 attached to the press 20 infeed portion as seen in FIG. 2. Such screw conveyers 18 may also be coupled directly to a screw press 46 infeed screw as seen in FIG. 3, thereby eliminating the need for a separate drive mechanism 42 as shown in FIG. 2. Any liquid overflow in the hopper 38 passes through the overflow pipe 44 attached to the hopper 38 shown in FIG. 4 and enters the system tank 14. As indicated above, other types of presses may also be employed, such as the piston press 41 shown in FIG. 7. However, it should be understood that alternate means for injecting materials directly into the screw press may be employed by simply closing the infeed hopper as illustrated in FIG. 10, substituting an infeed device such as a Moyno type pump. Such an arrangement further increases the press's efficiency especially when a low solid to liquid ratio is present. Still another embodiment of the piston press can also be seen in FIGS. 8 and 9, whereby a dual piston pump 50 is utilized which provides a means for drawing the slurry 16 being supplied to the hopper 52 into the ram tube 54 as a result of retraction of an internal piston 56, shown in FIG. 9 attached to the hydraulic ram cylinder 58 adjacent the ram tube 54. Valves 60, 60' located below the hopper 52 open alternately to allow the slurry to pass to each ram tube 54, 54' via valve 62. When the internal ram piston 56 is fully withdrawn an operating system reverses the piston 56 travel, whereby the valve 60 located below the hopper 52 is then closed simultaneously with valves 62' being opened at the entrance to the ram tube 54', juxtaposed the ram tube 54, being filled, and sequentially opening the discharge valve 63 located between the discharge merging element 66 and the press screen 74, the piston 56 then moves forward in the first cylinder 54, thereby expelling the slurry 16, while additional slurry material 16 is being taken into the second tube 54' by hydraulic ram cylinder 581 and piston 56' (not shown). The slurry 16 being expelled by each ram tube 54, 54' in turn is then forced into the 30 merging connector 66. A solids discharge zone at the end of the discharge tube 70 is essentially the same for all the presses disclosed herein. Restriction cylinders 68 are controlled remotely, thereby establishing the opening 72 between conical plug 80 and seat 82 thus providing compaction of the solids residue 24. The slurry 16, under pressure from the ram piston, 56 forces the slurry 16 linearly through a strainer screen 74. As a result of compaction in the discharge tube 70, fluids less than 50 micron are expelled through a screen sieve 74. The expunged fluid 22 is then returned to the system tank 14 while the more dense solids residue 24 greater than 50 micron is forced through the discharge tube 70. The system then reverses the operation for the alternate ram cylinder 58', thus creating a push pull operation. Therefore, while one ram cylinder 54 is filling, the adjacent cylinder 54' is being discharged. The solids residue 24 being forced through the discharge tube 70 is thereby extruded at a steady rate, controlled by the gap 72 between the elliptical plug 80 and its seat 82. The length of the discharge tube 70 and ambient temperature further enhance compaction, thus further reducing the moisture content of the discharge material 24.

Figure 4:
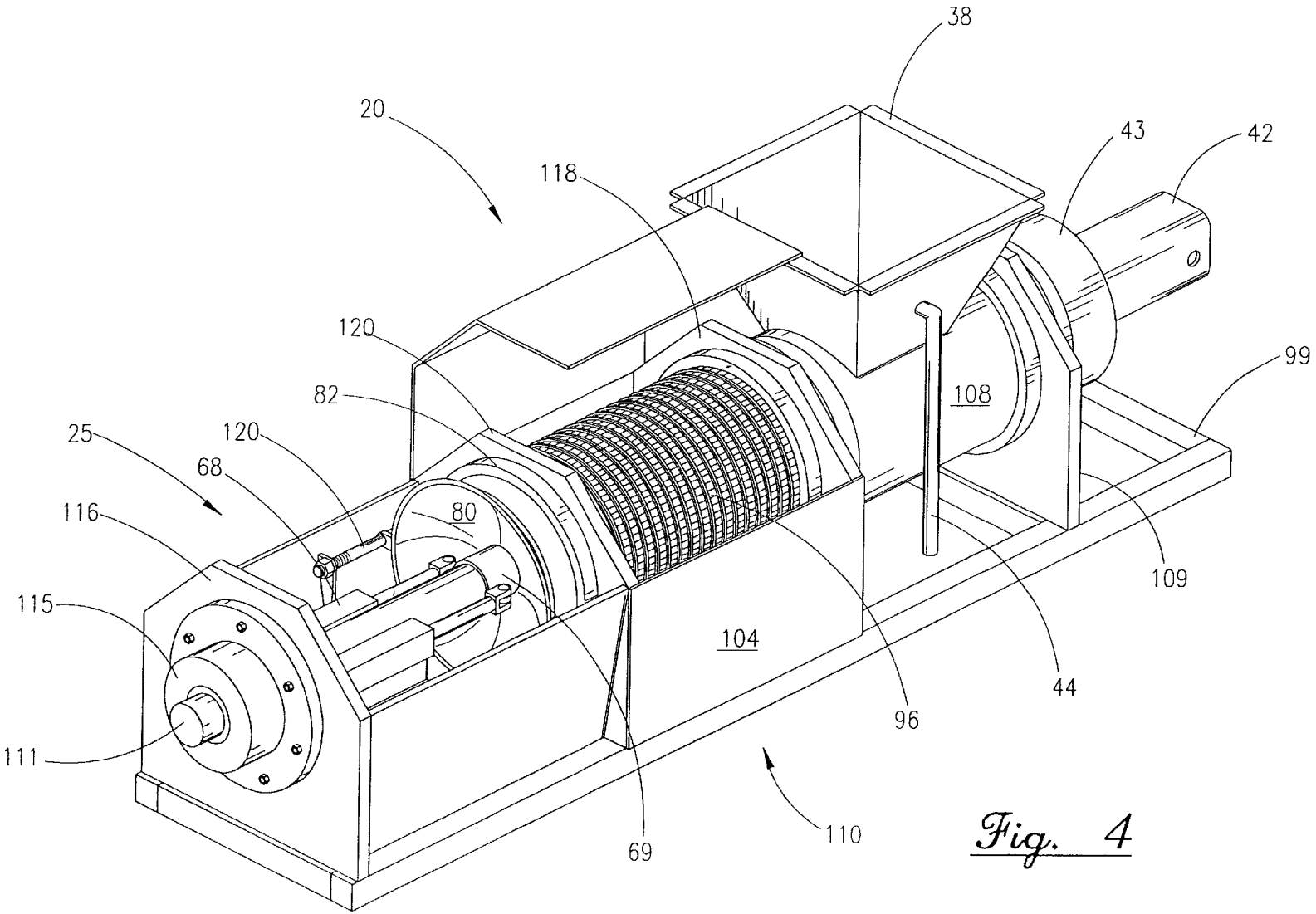
FIG. 4 is a an isometric view of the present invention.
Figure 6:
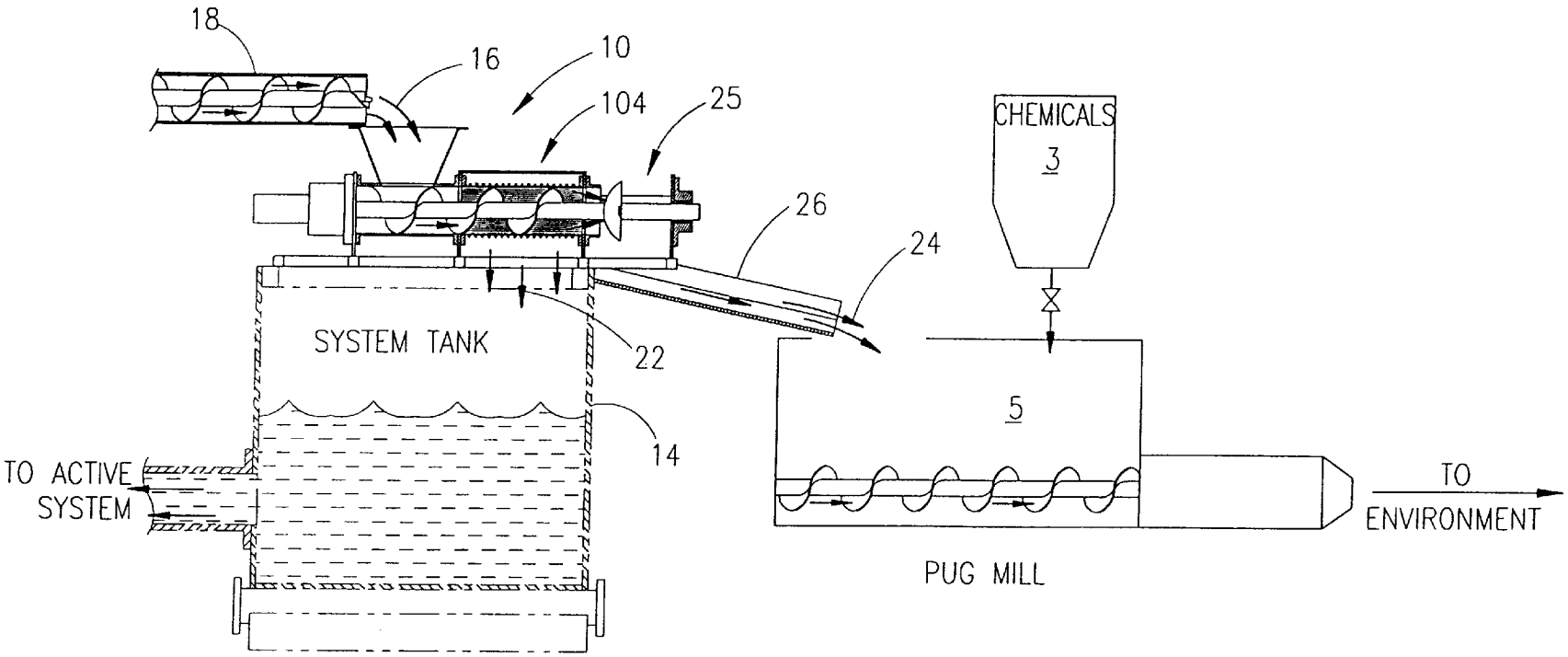
FIG. 6 is a cross section elevation showing the present invention discharging into a pug mill having chemical infeed capability.

The screw press 20 assembly as shown in FIG. 4 provides a better understanding of the requirement of a defluidizing press when applied to drilling fluid slurry 16. The slurry 16 is seldom consistent with respect to its volume or its density and, therefore, a positive means of controlling the restriction plug 80 is essential. Drilling fluid slurry 16 may vary in its consistency and at times may contain as little as 10% solids. Screw presses 20 have a tendency to become static when insufficient solids are present. Other press types and embodiments are disclosed herein which are capable of solving these problems. If a screw press 20 is used, it must have a more positive means of sealing between the screw flighting 90 and the cylindrical walls 92 as seen in FIG. 3. It is also imperative that the orifices 96 shown in FIG. 11 in the screen 94 be kept open. This may be accomplished by bonding a flexible material 98 to the flighting or constructing the screw from a polymeric material which allows for constant contact between the screw flighting 90 and the cylinder wall 92. Other methods of reducing static conditions and/or cavitation are shown in FIG. 10, wherein a valve 100 is applied between the infeed hopper 38 and the feed screen 74 and a vacuum line 101 and valve 102 are connected to the defluidizing zone 104. This negative pressure increases flow and insures a positive flow of recovered fluid 22 through the defluidizing screens 74. A positive pressure may also be used to increase flow through the defluidizing zone 104 through the use of air nozzles 106 located in the inflow zone 108. It is further anticipated that a chemical, such as calcium carbonate, can he added to the slurry inflow zone from a chemical tank 110 controlled remotely by a feed valve 112, thereby enhancing the defluidization process. As seen in FIG. 6, a screw press 20 may also he used in conjunction with a pug mill 5, whereby chemicals 3 such as lime and fly ash are mixed with the solid cuttings residue 24 prior to discharge into the environment. As best seen in FIG. 4 press 20, as well as in other section presses 40, 41 and 46, depicted in 9, 7 and 3 respectively, restriction in the compaction zone 25 of the discharge portion is effected in most cases by a pair of cylinders 68 disposed parallel either side the linear axis of the discharge flange 82. The cylinders 68 are adjusted remotely to position the conical restriction member 80 relative to the discharge flange 82, thereby providing infinite positive control of the discharge of defluidized material 24. The compacted solids 24 have a natural tendency to adhere to the inside diameter of the screen 74. It has been found that a relatively small vibrator 140 can be placed on the outer diameter of the screen in the manner illustrated in FIG. 12, thus imparting a vibration over the face of the screen eliminating much of the material adhesion.

Figure 11:
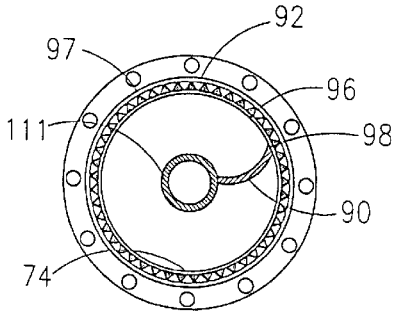
FIG. 11 is a partial cross section of the screen element.
Figure 12:
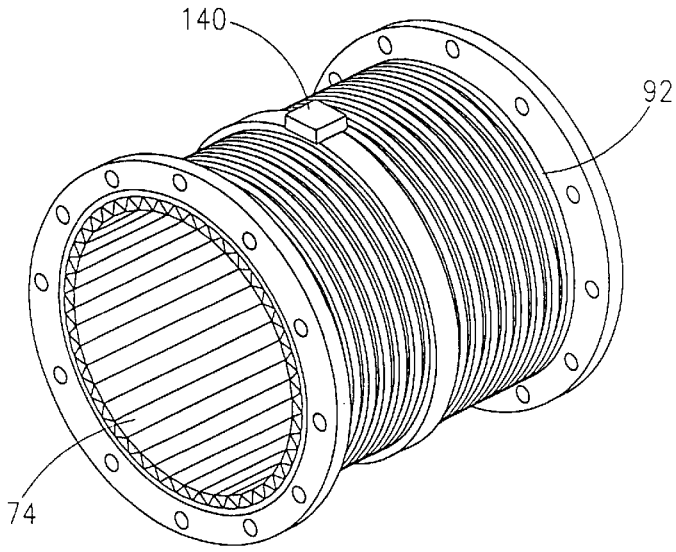
FIG. 12 is an illustration of a vibrator and band assembly located around the sieve screen.
Figure 13:
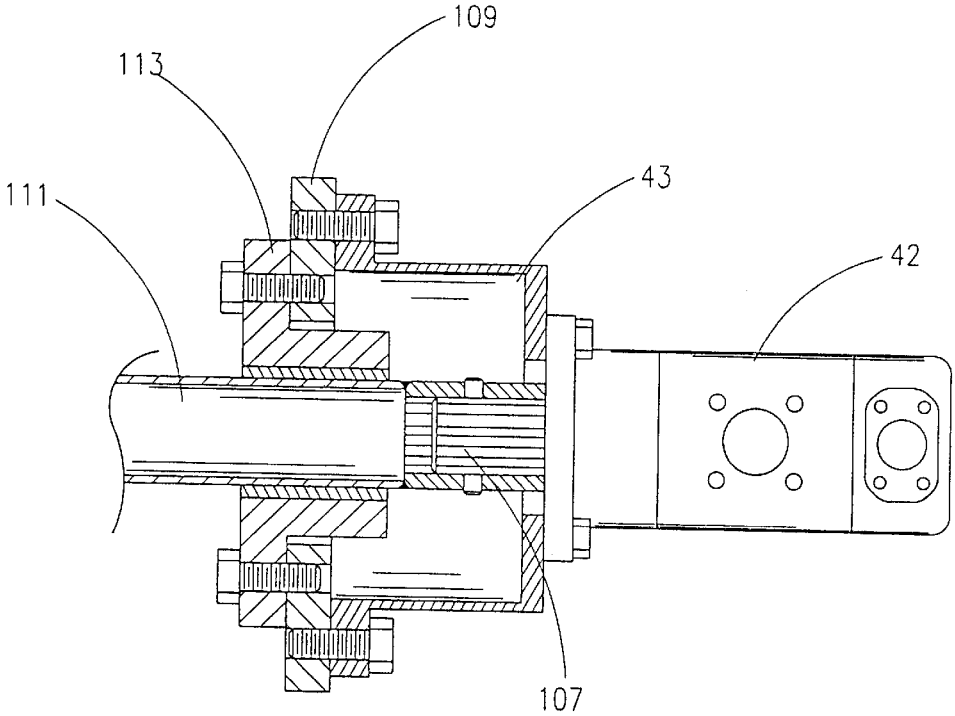
FIG. 13 is a partial cross section view of the drive motor mounted to the screw shaft.

As seen in FIG. 4 the screw press 20 is divided into three zones, 30: The infeed zone comprising a hopper 38 having an overflow tube 44, the hopper 38 located above and adjacent to the screw infeed compartment 108, a defluidizing zone 104, a fluid discharge 22 as illustrated in FIG. 2 and 3, and a solids discharge zone 25. The slurry 16, containing solids and drilling additives to be separated, is conveyed to the infeed hopper 38 and thus to the screw press 20 where any excess fluid is vented off through the overflow pipe 44. Most of the fluids in the slurry 16 are drained off through the separator strainers 74 in the defluidizing zone 104 prior to compaction. Compaction as a result of the solids being forced through the opening 72 between the restriction plug 80 the seat 82 in the compaction zone 25 by the press screw flights 90, forces any remaining liquids 22 having a diameter smaller than 50 micron from the slurry 16 via sieve screen 74. As seen in FIG. 4 the typical screw press of the present invention comprises a base frame 99 having vertical supports 109,116,118,and 120 extending upwardly there from; an infeed zone comprised of a hopper portion 38 mounted to a tubular infeed housing 108, having a flange fitting at each end, one end of which is supported inboard to vertical support 109 with the opposite end attached to one side of support 118. The press further comprises a driver motor 42 mounted to the external flange housing 43, shown in FIG. 4, secured to the outboard side of the vertical support 109 adjacent the infeed housing 108. As seen in FIG. 13 the drive motor shaft 107 is coupled directly to an output shaft 111, extending through the external flange housing 43, and held in axial alignment by a head shaft bearing 113 located within the external flange housing 43. The hollow screw shaft 111 is fitted with an internal spline, which engages the drive motor output shaft 107. Shaft 111 fitted with helical screw flighting 90, shown in cross section in FIG. 11, is provided beginning in the infeed housing 108 and extending axially through the defluidizing zone 110 ending just short of the discharge flange 82 at support 116. A flange bearing 115 mounted to a vertical support 116 rotatably supports the shaft The press further comprises a defluidizing zone 110 adjacent to the infeed zone, separator strainers 74, a collection chamber 104 surrounding the strainers, and a fluid discharge aperture 114 below the strainer passing through the base frame 99. The separator strainer or sieve screen 74 as illustrated in FIG. 11 comprises a 50 micron screen 94 backed by a plurality of wedged shaped, axially extending, parallel slats 97 held in an equally spaced, circumferential relationship by multiple supporting rings 93, slats 97 having a spacing between their widest portion of precisely 0.004 of an inch for 50 micron separators used for most drilling fluid recovery systems, with larger spacing used for greater micron screening for primary or special applications. Slats are formed into a radial diameter coinciding with the inside diameter of the infeed housing flanges corresponding to the infeed housing discharge flange are secured to each end of the wedged shaped slats, thereby defining a flanged tubular section. At least three torsion members secured to and extending axially between the flanges are attached to each of the supporting rings, providing a ridged, structural unit. Any number of these strainer sections may be connected together and utilized as necessary to provide sufficient separation of the entrained solids. The strainer flange adjacent the discharge is secured to a vertical frame member 118 having a diametrical bore equal to the flange inside diameter.

The screw press further comprises a discharge zone comprising a flanged reducing tubular portion 82 having an internal diameter less than an internal diameter of the strainer screen sieve 74, the reducing flange 82 being mounted to the discharge side of the base frame, vertical support member 120 adjacent the defluidization zone 110, a conical disk 80, slidable along the screw shaft 111, operated by a pair of ram cylinders 68 connected to a collar 69 at the back side of the conical disk.

Figure 7:
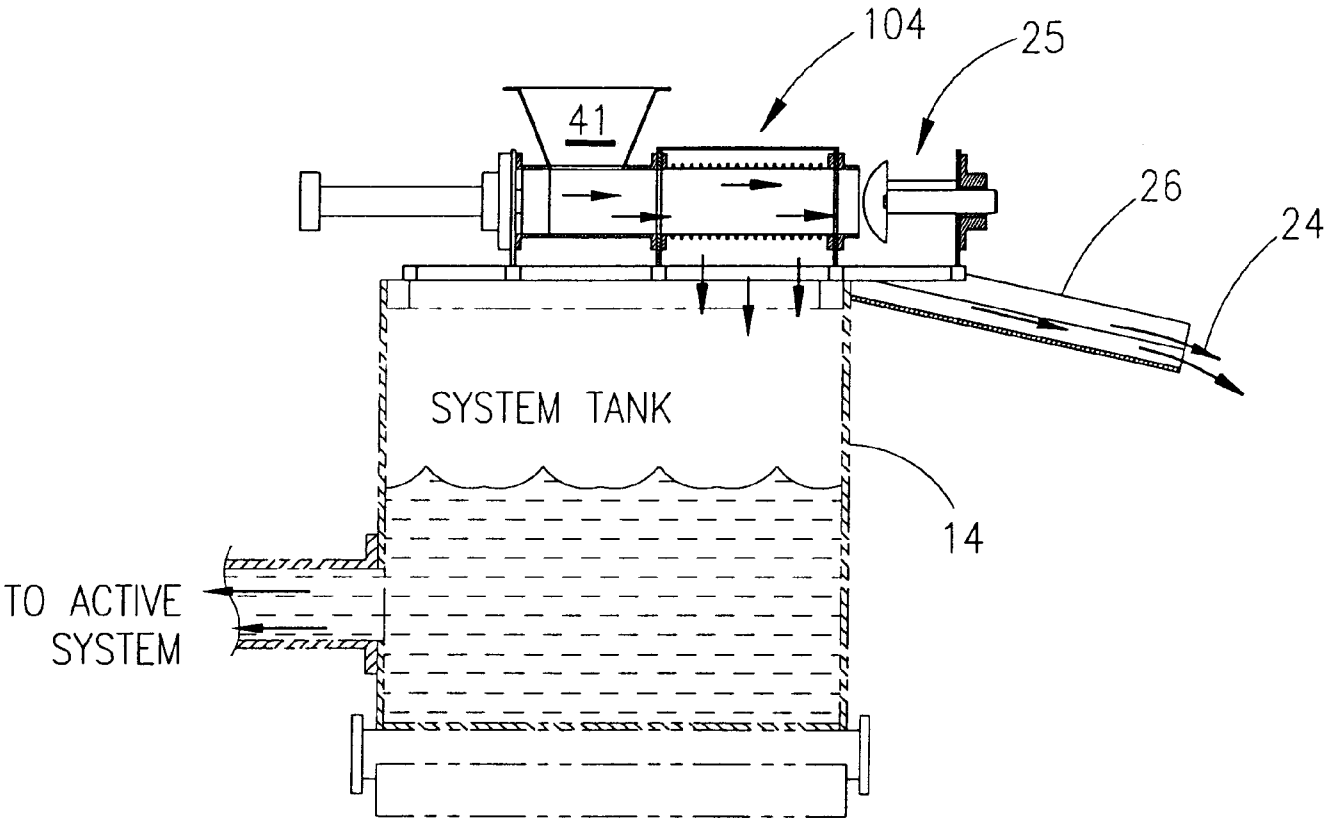
FIG. 7 is a cross section elevation of a second embodiment of the press having hydraulic ram feed.
Figure 8:
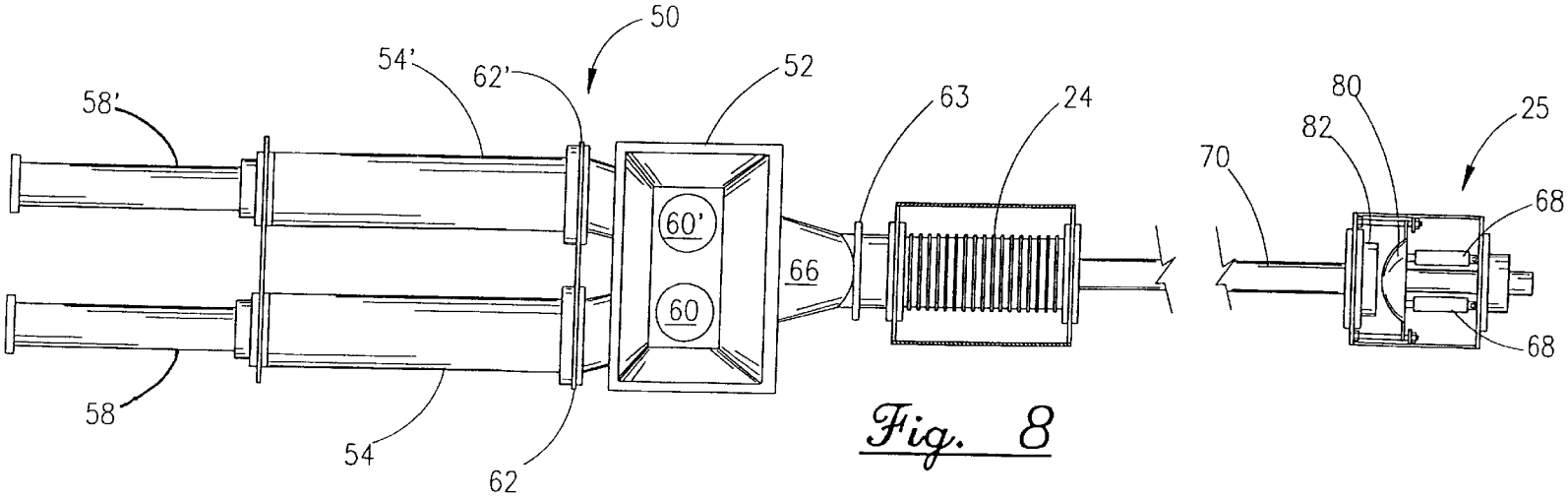
FIG. 8 is a plan view of a third embodiment showing a piston pump having defluidizing capability.
Figure 9:
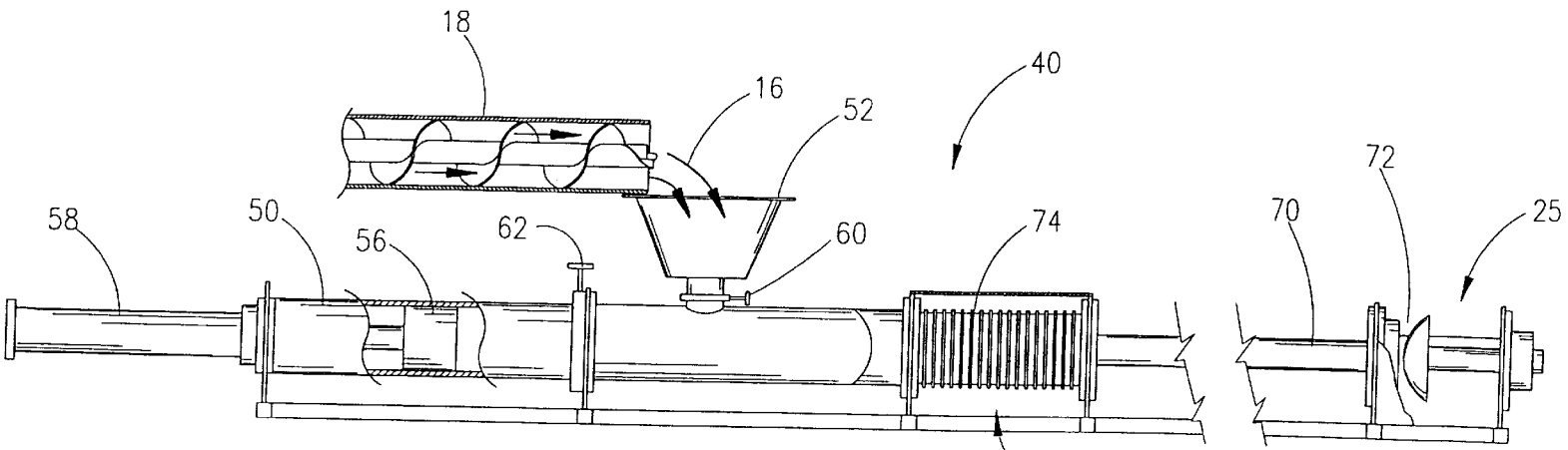
FIG. 9 is a side elevation of the piston pump in FIG. 8.
Figure 10:
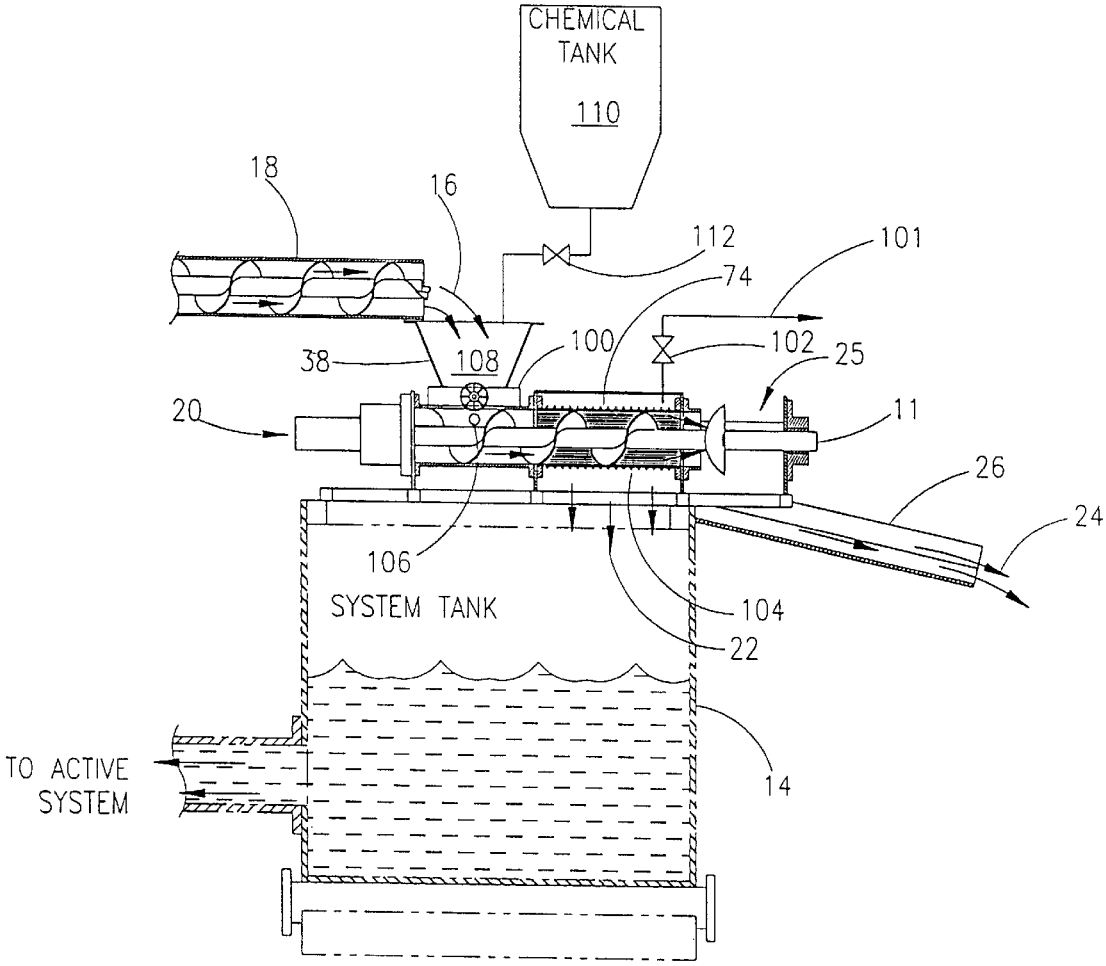
FIG. 10 is a side elevation and cross section of a screw press having means for applying pressure or vacuum to the defluidizing means.

A drive motor 42 by direct coupling may drive the screw press 20 to the infeed conveyor 18 as seen in FIG. 3, or by pistons as illustrated in FIGS. 7, 8, and 9. In any case the slurry 16 is urged through the defluidizing zone 110 towards the discharge zone 25. In cases utilizing rotating screw flighting 90, such flighting ends just short of the restriction element 80, as does the piston stroke. The elliptical restriction element 80 is slidable and rotatably fitted over the hollow feed screw shaft 111, thereby allowing the restriction element 80 to be positioned at various positions adjacent the discharge flange 82, such positioning being controlled by positioning cylinders 68 disposed on each side of the extension shaft 111 and attached to the elliptical restriction element 80. The positioning cylinders may be controlled remotely or manually adjusted. Rotation of the restriction element 80 is prevented relative to the rotating screw shaft 111 by torque arresters 121. With the restriction element 80 positioned in close proximity to the discharge flange 82, the discharge of the semi-dry drill cuttings 24 can be infinitely controlled. In this manner, the solids from the slurry 16 are compacted, thereby forcing a significant amount of the remaining fluids 22 through the screens 74. The defluidization zone 110 defining an enclosure 104 surrounding the screen 74, enhances the ability of the press 20 to remove fluids rapidly. It has been found that a screen sieve 74 having a 50-micron admissibility is sufficient to recover most drilling additives in the slurry 16. It has also been found that a residue 24 moisture content of less than 40% can be achieved. It has also been found that a primary press of this nature can remove 40% by volume of the oil or water in a slurry 16 directed from the rig's cuttings shaker system, thereby reducing the moisture content of the discharge material 24 to as little as 13.4% liquid by weight.

Figure 5:
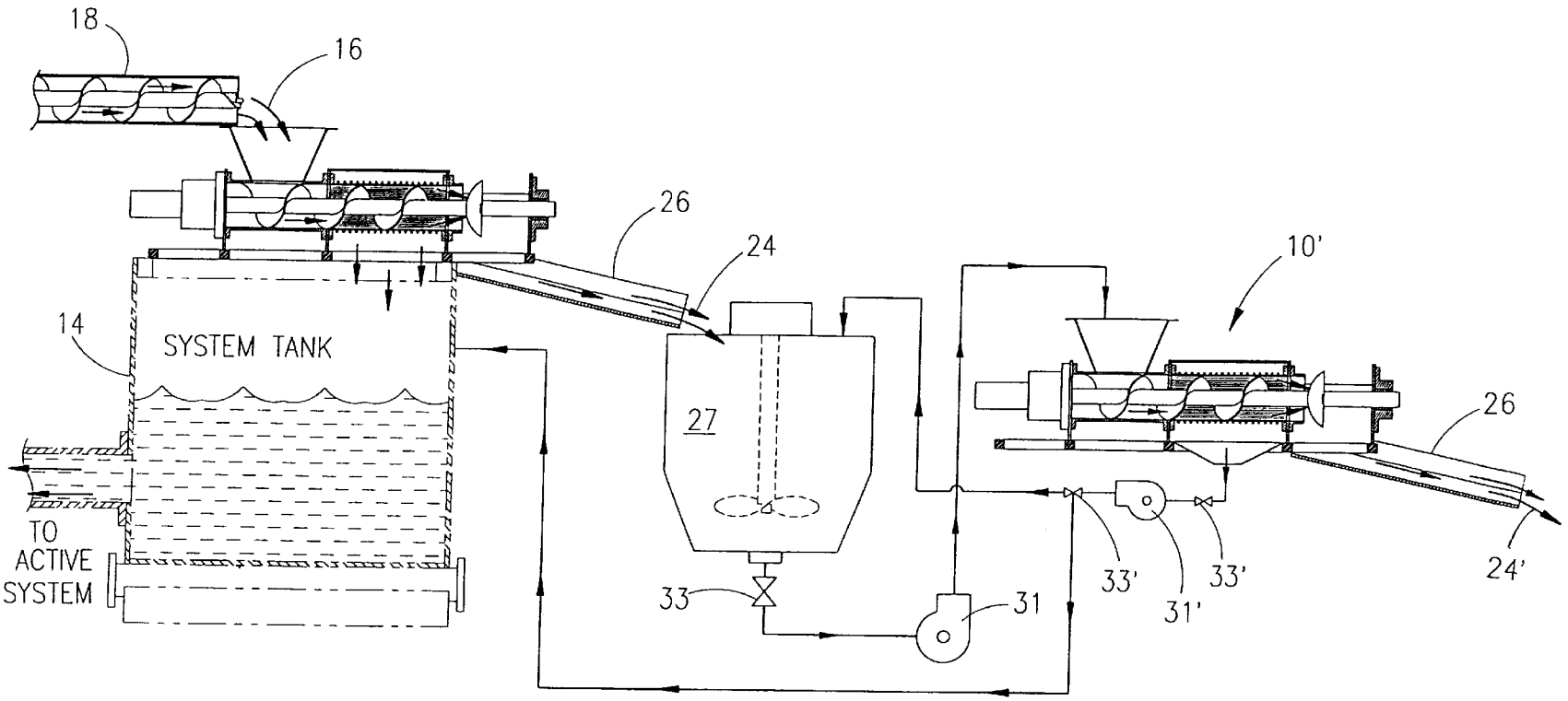
FIG. 5 is a cross sectional elevation and piping diagram of a two-press system utilizing a circulating tank.

A second stage press 10' operation as illustrated by FIG. 5 could reduce the liquid content of the disposable cuttings 24 to less than 10% by wt. However, as illustrated, a circulating tank 27 may be necessary to maintain the slurry in solution. A system of pumps 31, 31' and valves 33, 33' for moving the fluids from the recirculating tank to the second stage press and from the second stage press back to the recirculating tank or system tank may also be needed.

Figure 14A:
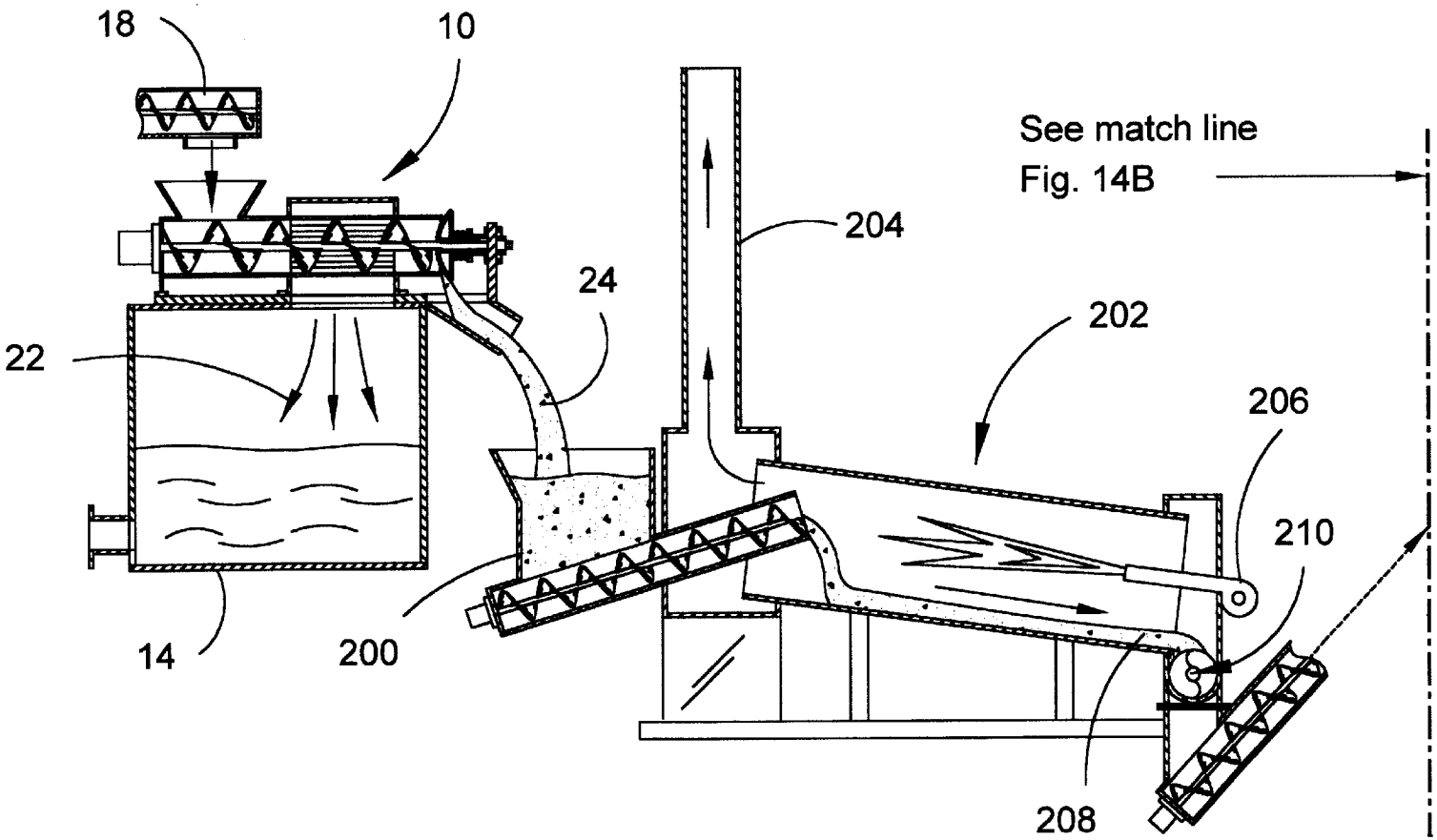
FIG. 14 is a vertical cross section view illustrating a cuttings drying system utilizing the disclosed technology.
Figure 14B:
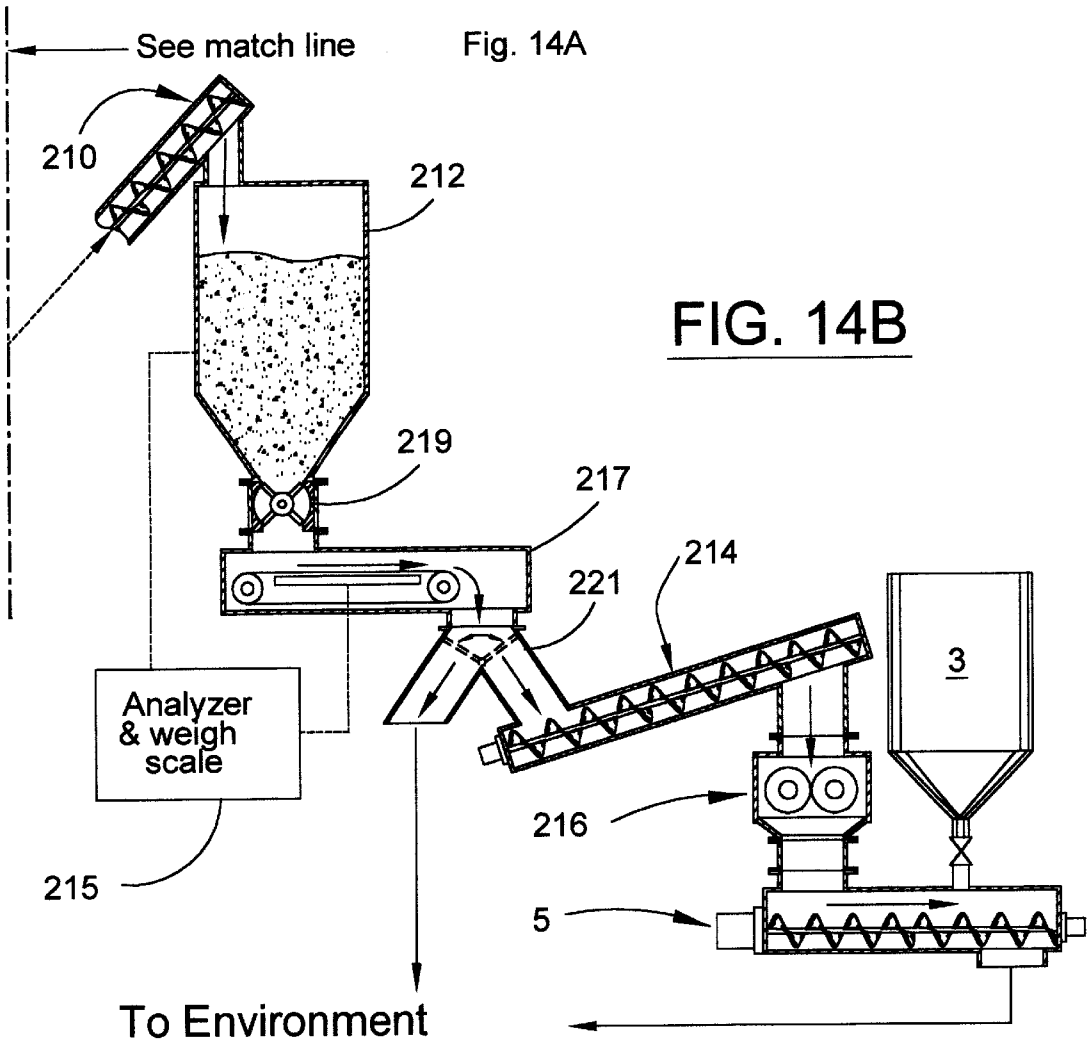
Figure 15:
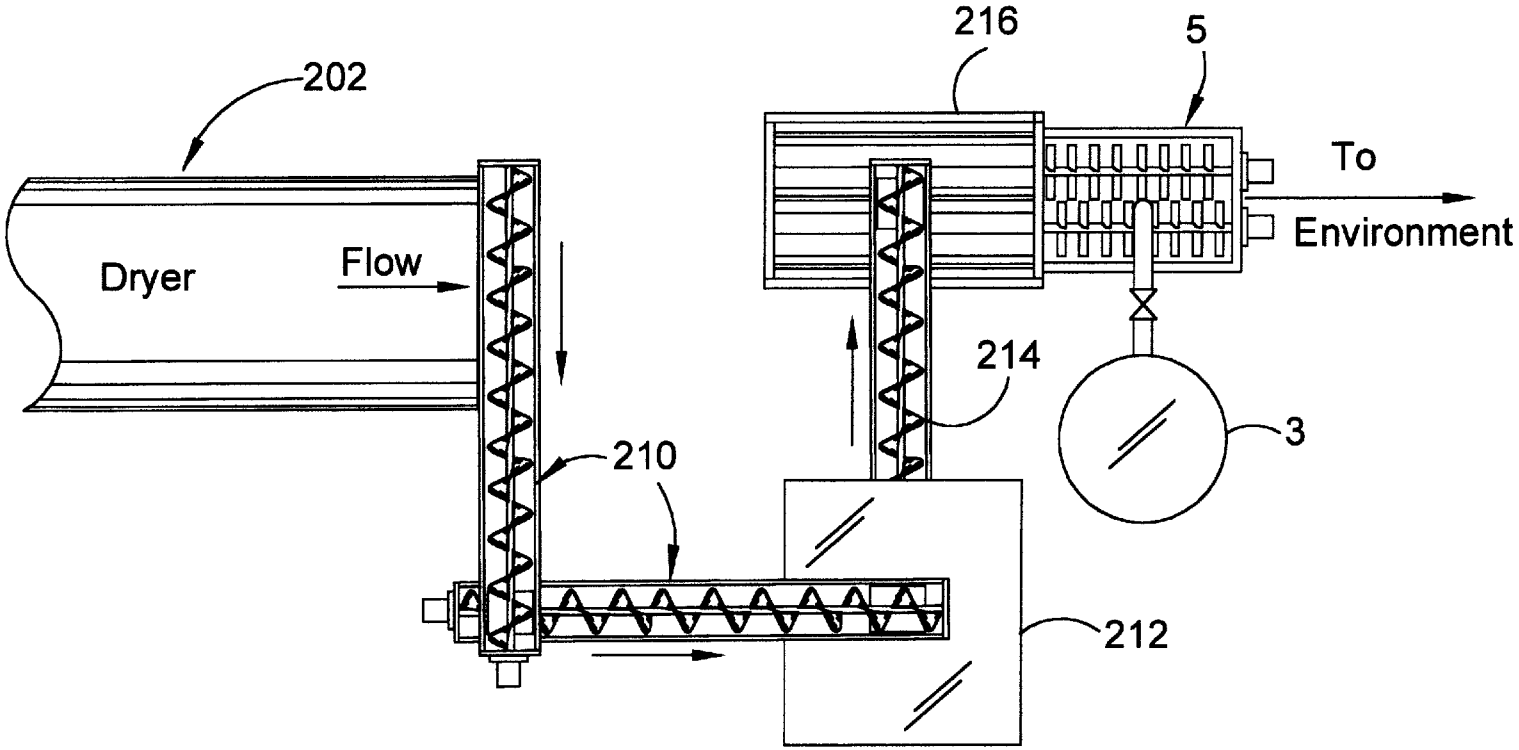
FIG. 15 is a partial top view of the system illustrated FIG. 14.

Cuttings at the transport stage generally contain about 6.5% residual petroleum residue along with small percentages of other chemicals. Cuttings processed by the press 10 whereby the drilling fluids are recovered generally contain only about 3% residual petroleum residue. Therefore, as seen in FIG. 14 it is contemplated that the semi-dry cuttings 24 being discharged from the press 10 may also be further processed by feeding the cuttings to the feed bin 200 of a rotary kiln 202 or other such drying apparatus. It is also anticipated that a wide variety of dryers and/or retorts may be used for this purpose such as exhibited in the Handbook of Industrial Dryers including but not limited to Vibrated Beds, Fluid Beds, Cyclones, Turbo tray, Sprag, Pneumatic dryer, Pulse Combustion Dryer, Agitated Flash and contact, Vortex, Rotary, centrifugal and jet pro dryers. The dryer exhaust maybe discharged to atmosphere or to air scrubbers. Further, such drying apparatus may also be heated by scavenged heat from other equipment located on the drill site provided temperatures exceed the flash point of crude oil generally around 300 degrees. Where the petrochemical coated cuttings are fed into the kiln and ignited, the petrochemicals are driven off in vapors through the exhaust stack, recycled to the burner 206, or otherwise environmentally controlled as known within the art. The dried, sterile, and sanitized cutting solids discharged from the dryer may then be computer analyzed for hydrocarbon and chemical content and weighed thereby calculating total cuttings per hour being removed from the well on a continuous basis, thereby providing valuable data to the driller. Cuttings' having contaminates or residual petroleum residue of less than 1% (one percent) may then be discharged back into the environment at the well site such as deposition on the seabed adjacent offshore wells. However, the cuttings having higher contaminates may be moved by conveyer 210 to a collection container for deposit into one or more of the collection and transport or distribution means illustrated in FIG. 1. The cuttings may also be conveyed to a holding tank or retort 212 where the cuttings are continuously weighed upon entry and discharge, thereby determining the volume throughput and rate of cuttings discharge from the well being drilled. Sensors located in the holding tank or retort 212 may be computer analyzed by the analytical system 215 which may also selectively control the metered discharge by conveyer 214. Various metering means may also be employed for discharging the dyed cuttings directly to the environment or to a high volume fine grinder 216 such as a mill or pulverizer, prior to reinjection back into the well or depositing the fines in the mixing mill 5 illustrated earlier in FIG. 6, where lime and fly ash and the like are mixed with the solids to enhance neutralization prior to transport and distribution at a land fill as illustrate by the flow path seen in FIG. 15. However, the arrangement may vary depending on the type of dryer chosen.

Figure 16:
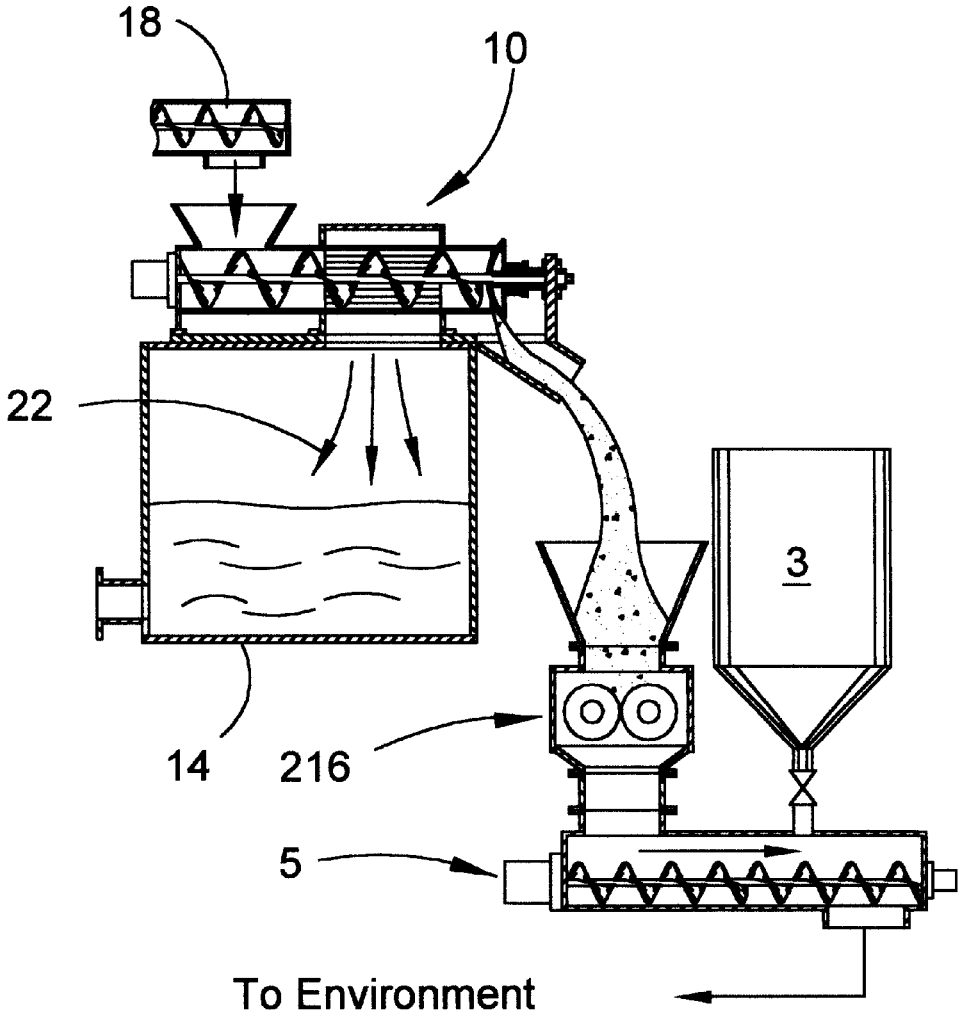
FIG. 16 is a vertical cross section of an alternative system utilizing the disclosed technology.

As shown in FIG. 16, the semi-dry solids 24 may also be deposited directly into the fine grinder 216 and the mixing mill 5 without drying the solids, in which case the fine solids are then combined with slurry additives which enhance flow of the solids for injection back into the earth formations through the high-pressure injection pump system 28 seen in FIG. 1.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A drill cuttings processing system comprising:

a) a conveying and holding system for collecting and receiving a drill cuttings slurry said slurry comprising drilling fluids and earth solids developed while drilling a well;

b) a press having a screen means for compressively separating said solids in excess of 50 micron from said cuttings slurry and recovering said drilling fluids, said press being in fluid communication with said conveying and holding system;

c) a dryer, having means for receiving said solids, capable of flashing off moisture and any remaining drilling fluid residue;

d) a conveying means for transporting said solids from said press to said dryer;

e) a receiving tank capable of receiving said solids discharged from said dryer having means for continuous weighing and computer analyzing said solids for residual petroleum content; and f) a means for selecting between discharge of said solids from said receiving tank directly into the environment adjacent said well, further processing prior to transport to environmental deposit sites and reinjection into said well being drilled.

2. The drill cuttings processing system according to claim 1 wherein said system further comprises a fine grinder and mixing unit having a chemical injection unit for treating said solids prior to transport to environmental depository sites and a metering apparatus located adjacent said receiving tank for receiving said solids from said receiving tank and selectively metering said solids on a continuous basis into said find grinder.

3. The drill cuttings processing system according to claim 1 wherein said system further comprises means for selectively diverting said cuttings discharged from said mixing unit alternatively between a reinjection system and transport containers.

4. The drill cuttings processing system according to claim 1 wherein said dryer is heated to at least 300 degrees Fahrenheit.

5. The drill cuttings processing system according to claim 1 wherein said dryer is centrifugal and said receiving tank is a heated retort.

6. The drill cuttings processing system according to claim 5 wherein said retort is heated with scavenged heat.

7. The drill cuttings processing system according to claim 1 wherein said means for continuous weighing and computer analyzing, further monitors throughput volume of the cuttings passing through said receiving tank and determines percentage of residual petroleum content at point of discharge and selectively discharges said cuttings to the environment adjacent the well site on a go-no-go bases if contaminates are less than 1%.

8. A drill cuttings slurry processing system comprising:

a) a defluidizing screw press comprising:

i) a housing including an inlet for receiving a drill cuttings slurry;

ii) a cylindrical strainer extending forwardly from said housing, said strainer having apertures for passage of fluids being separated from said cuttings and a vibrator for assisting in separation of said fluids from said cuttings;

iii) a reducing flange extending forwardly from an outlet end of said strainer and defining a solids discharge opening at a terminal end thereof, an internal diameter of said reducing flange being less than an internal diameter of said strainer;

iv) a press screw member disposed in a space defined by said housing and said cylindrical strainer, said press screw member including a shaft and a screw affixed to an outer periphery of said shaft, said screw beginning in said housing at a location rearwardly of said strainer and terminating within said strainer, said shaft extending forwardly beyond said reducing flange;

v) a motor for driving said press screw member thus advancing said slurry forwardly within said space and through said discharge opening, whereby entrained solids are separated from said fluids by compaction at a controlled rate;

vi) a conical mouth piece, slidable and rotatable relative to said screw, fixed to said shaft for effecting closure of said reducing flange; and vii) means for slidably positioning said mouthpiece relative to said reducing flange;

b) a fine grinding means for receiving said defluidized drill cuttings and further particle sizing said cuttings;

c) a means for transferring solid defluidized drill cuttings discharged from said screw press to said grinding means; and d) a mixer attached to said grinding means having a chemical additive means for mixing chemicals with said cuttings prior to discharge for conveyance to environmental deposit sites.

9. The drill cuttings slurry processing system according to claim 8 further comprising a drying means capable of receiving said drill cuttings discharged from said screw press for further drying and sanitization of said drill cuttings prior to discharge into said fine grinding means.

10. The drill cuttings slurry processing system according to claim 9 further having a holding tank for receiving said drill cutting discharged from said drying means and weighing and computer analyzing said cuttings for chemical content prior to selectively discharging said cuttings to the environment.

11. The drill cuttings slurry processing system according to claim 10 wherein said drill cuttings discharged from said holding tank are selectively diverted directly to the environment adjacent the drill site prior to discharge into said fine grinder.

12. The drill cuttings slurry processing system according to claim 8 wherein said mixer discharges to a high-pressure cuttings injections system.

13. The drill cuttings slurry processing system according to 8 wherein mixer discharges into transport containers for transfer to environmental depositories.

* * * * *